US007750755B2

(12) United States Patent
Fujita et al.

(10) Patent No.: US 7,750,755 B2
(45) Date of Patent: Jul. 6, 2010

(54) TRANSMISSION LINE TRANSITION

(75) Inventors: Akihisa Fujita, Anjo (JP); Kunio Sakakibara, Nagoya (JP)

(73) Assignees: Denso Corporation, Kariya (JP); National University Corporation Nagoya Institute of Technology, Nagoya (JP)

( * ) Notice: Subject to any disclaimer, the term of this patent is extended or adjusted under 35 U.S.C. 154(b) by 210 days.

(21) Appl. No.: 11/703,811

(22) Filed: Feb. 7, 2007

(65) Prior Publication Data

US 2007/0182505 A1 Aug. 9, 2007

(30) Foreign Application Priority Data

Feb. 8, 2006 (JP) ..... 2006-031067

(51) Int. Cl.
*H01P 5/107* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS

| | | | | |
|---|---|---|---|---|
| 4,716,386 | A * | 12/1987 | Lait | 333/26 |
| 5,724,049 | A * | 3/1998 | Park et al. | 343/705 |
| 5,770,981 | A * | 6/1998 | Koizumi et al. | 333/26 |
| 6,239,669 | B1 * | 5/2001 | Koriyama et al. | 333/26 |
| 6,958,662 | B1 * | 10/2005 | Salmela et al. | 333/26 |
| 2003/0231078 | A1 * | 12/2003 | Koriyama et al. | 333/26 |
| 2004/0041651 | A1 * | 3/2004 | Shono | 333/26 |
| 2004/0119554 | A1 * | 6/2004 | Tahara et al. | 333/26 |
| 2005/0200424 | A1 * | 9/2005 | Takeda et al. | 333/26 |
| 2007/0052504 | A1 * | 3/2007 | Fujita | 333/238 |

FOREIGN PATENT DOCUMENTS

| | | |
|---|---|---|
| EP | 1 367 668 | 12/2003 |
| JP | U-S59-132202 | 9/1984 |
| JP | 06-112708 | 4/1994 |
| JP | 10-126114 | 5/1998 |
| JP | 11-261312 | 9/1999 |
| JP | 2004-112131 | 4/2004 |

OTHER PUBLICATIONS

Office Action dated Sep. 1, 2009 from the Japan Patent Office in the corresponding patent application No. 2006-031067 with English translation.

Office action dated Feb. 9, 2010 in corresponding German Application No. 10 2007 005928.2.

* cited by examiner

*Primary Examiner*—Benny Lee
(74) *Attorney, Agent, or Firm*—Harness, Dickey & Pierce, PLC

(57) ABSTRACT

A transmission line transition for coupling electromagnetic energy between different transmission lines includes first and second dielectric substrates laminated to each other and a waveguide tube attached to the first dielectric substrate. The laminated dielectric substrate provides a dielectric waveguide having a first end short-circuited and a second end communicating with a hollow interior of the waveguide tube. An antenna connected to a planar line is disposed in the dielectric waveguide and spaced from the short-circuited end of the dielectric waveguide by a predetermined distance in a longitudinal direction of the waveguide tube to excite and to be excited by the waveguide tube. The dielectric waveguide has a cross-sectional area smaller than that of the interior of the waveguide tube and coincides with the interior of the waveguide tube in the longitudinal direction.

13 Claims, 6 Drawing Sheets

TRANSMISSION LINE TRANSITION

CROSS REFERENCE TO RELATED APPLICATION

This application is based on and incorporates herein by reference Japanese Patent Application No. 2006-31067 filed on Feb. 8, 2006.

FIELD OF THE INVENTION

The present invention relates to a transmission line transition having a dielectric substrate and a waveguide tube disposed on the dielectric substrate.

BACKGROUND OF THE INVENTION

Recently, a millimeter wave system for large, high-speed communication or vehicular radar has been developed. In such a millimeter wave system, a transmission line transition is used for coupling electromagnetic energy, for example, between a waveguide tube and a planar line (e.g., a microstrip line) formed on a dielectric substrate.

As shown in FIGS. 9A and 9B, a conventional transmission line transition, for example, disclosed in JP-H11-261312A includes a dielectric substrate P1 (FIG. 9B) and a waveguide tube consisting of first and second waveguide members P2, P3 that are fixed to each other through the dielectric substrate P1. A microstrip line P4 and a ground plane P6 (FIG. 9B) are disposed on first and second surfaces of the dielectric substrate P1, respectively. The tip portion of the microstrip line P4 is positioned inside the waveguide tube and acts as an antenna P5 for exciting the waveguide tube.

The millimeter wave system consists of very small components. Therefore, manufacturing variations may be caused when the components are formed and assembled. The manufacturing variations cause characteristic variations between the manufactured systems.

For example, in the case of the transition shown in FIGS. 9A and 9B, it is difficult to accurately form the first waveguide member P2 and to accurately fix the first waveguide member P2 to the dielectric substrate P1. Therefore, is not suited for mass-production.

A distance between the tip of the antenna P5 and the ground plane P6 determine characteristics of the transition. As shown in FIG. 9B, the second waveguide member P3 is fixed to the ground plane P6. Therefore, if the second waveguide member P3 is fixed to an incorrect position on the ground plane P6, the transition has characteristics different from desired characteristics.

To reduce the manufacturing variations, the components of the transition need to be highly accurately formed and assembled. As a result, manufacturing time and cost of the transition is increased.

SUMMARY OF THE INVENTION

In view of the above-described problem, it is an object of the present invention to provide a transmission line transition having a structure that prevents a characteristic variation caused by a manufacturing variation so that the transition can be mass-produced.

A transmission line transition for coupling electromagnetic energy includes first and second dielectric substrates laminated to each other and a waveguide tube attached to the first dielectric substrate. The laminated dielectric substrate provides a dielectric waveguide having a first end short-circuited and a second end communicating with an interior of the waveguide. An antenna connected to a planar line is placed in the dielectric waveguide and spaced from the short-circuited end of the dielectric waveguide by a predetermined distance to excite the waveguide tube.

The short-circuited end reflects a signal propagating through the waveguide tube and the dielectric waveguide and a standing wave occurs in the dielectric waveguide. The antenna is positioned at an anti-node of the standing wave. In such an approach, the electromagnetic energy can be efficiently coupled between a first transmission line consisting of the waveguide tube and the dielectric waveguide and a second transmission line consisting of the planar line.

The transition achieves the short-circuited end of the dielectric waveguide without using a second waveguide member P2 of the conventional transition. In other words, while the transition uses a single-piece waveguide tube, the conventional transition uses a two-piece waveguide tube. Therefore, the transition can be accurately and easily assembled, at least compared to the conventional transition, so that the transition can be mass-produced.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
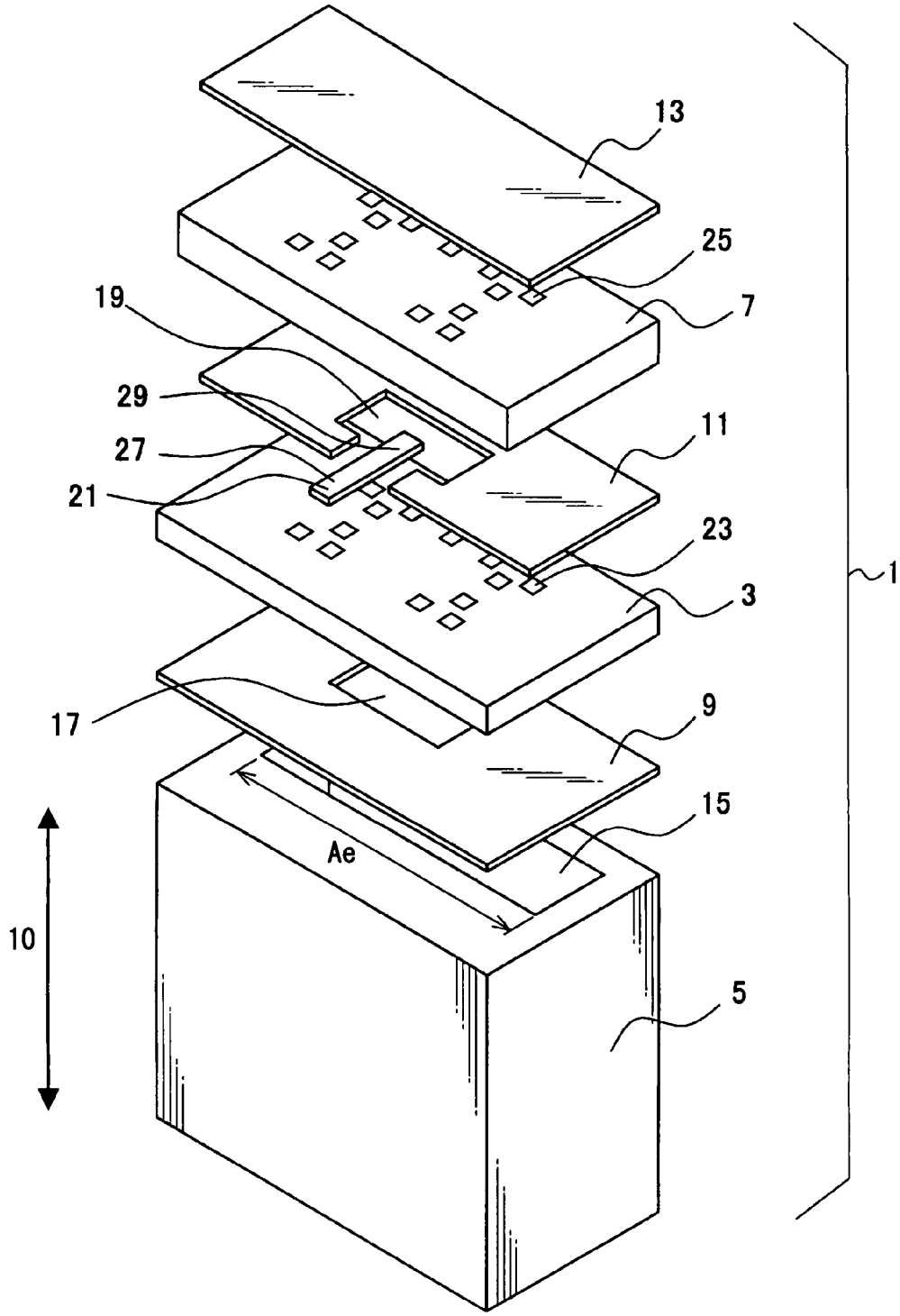
FIG. 1 is an exploded view of a transmission line transition according to a first embodiment of the present invention.
Figure 2A:
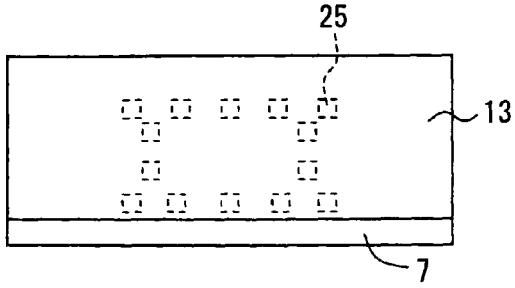
FIG. 2A is a top view of a third ground plane on a second dielectric substrate of the transition.
Figure 2B:
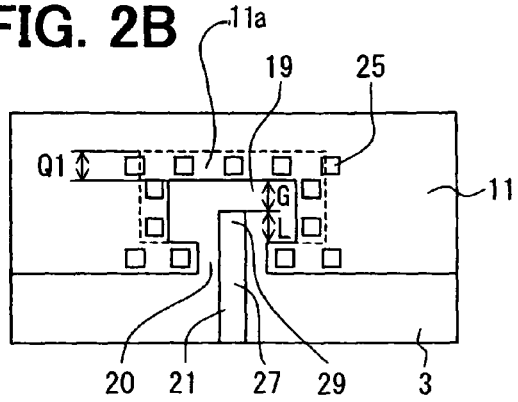
FIG. 2B is a top view of a second ground plane on a first dielectric substrate of the transition.
Figure 2C:
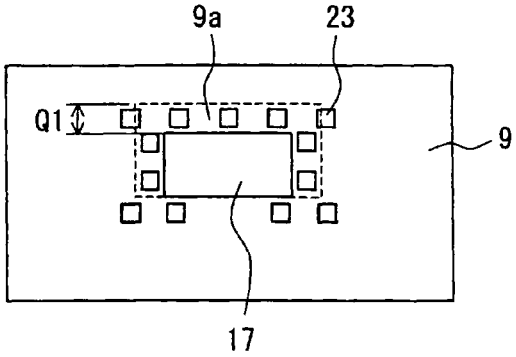
FIG. 2C is a top view of a first ground plane of the transition.
Figure 2D:
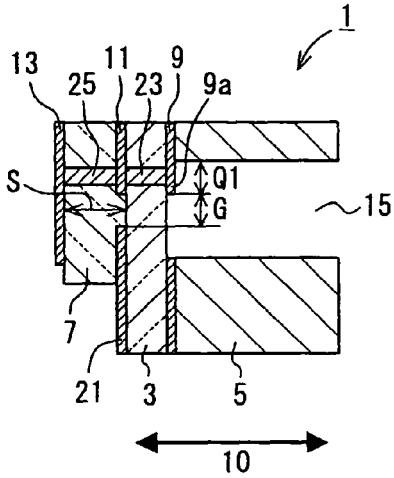
FIG. 2D is a cross-sectional view of the transition, taken along its longitudinal direction.

A planar line-to-waveguide transition 1 for coupling electromagnetic energy between a planar line and a waveguide is shown in FIGS. 1 and 2A-2D. The transition 1 (FIGS. 1, 2D) includes a first dielectric substrate 3 (FIGS. 1, 2B, 2D), a waveguide tube 5 (FIGS. 1, 2D), a second dielectric substrate 7 (FIGS. 1, 2A, 2D), and first, second, and third ground planes 9 (FIGS. 1, 2C, 2D), 11 (FIGS. 1, 2B, 2D), 13 (FIGS. 1, 2A, 2D).

The first dielectric substrate 3 may be, for example, made of alumina. The first dielectric substrate 3 has a first surface on which the first ground plane 9 is disposed and a second surface on which the second ground plane 11 is disposed.

The waveguide tube 5 may be, for example, a hollow rectangular tube made of aluminum. The waveguide tube 5 has a hollow interior 15 (FIGS. 1, 2D) with a rectangular cross section. One open end of the waveguide tube 5 is fixedly secured to the first dielectric substrate 3 through the first ground plane 9 by brazing, screws, or the like. The waveguide tube 5 has a longitudinal direction 10 shown in FIGS. 1 and 2D and the electromagnetic energy propagates in the longitudinal direction 10.

The second dielectric substrate 7 may be, for example, made of alumina. The second dielectric substrate 7 has a first surface on which the second ground plane 11 is disposed and a second surface on which the third ground plane 13 is disposed. Thus, the second ground plane 11 is sandwiched between the first and second dielectric substrates 3, 7.

The first ground plane 9 is made of electrically conductive material (e.g., metal thin film) and has a rectangular opening 17 in its center, as shown in FIGS. 1 and 2C. The area of the opening 17 is smaller than a cross-sectional area of the interior 15 of the waveguide tube 5. The first ground plane 9 is positioned relative to the waveguide tube 5 such that the opening 17 is entirely within the interior 15 of the waveguide tube 5 in the longitudinal direction 10, as shown in FIGS. 2C and 2D.

Specifically, a bottom edge of the interior 15 is aligned with a bottom edge of the opening 17 so that the first ground plane 9 has a project portion 9*a* (FIGS. 2C, 2D) projecting from a top edge of the interior 15 by a distance Q1 (FIGS. 2B, 2C, 2D). Also, the first ground plane 9 projects from side edges of the interior 15 by a certain distance. Thus, the first ground plane 9 is positioned relative to the waveguide tube 5 such that the opening 17 is entirely within the interior 15 in the longitudinal direction 10.

The second ground plane 11 is made of electrically conductive material and has a rectangular opening 19 in its center, as shown in (FIGS. 1 and 2B). The opening 19 has the same area as the first rectangular opening 17. The second ground plane 11 is positioned relative to the first ground plane 9 such that the opening 19 is aligned with the opening 17 in the longitudinal direction 10. As with the opening 17, therefore, the opening 19 is entirely within the interior 15 of the waveguide tube 5 in the longitudinal direction 10. Also, the second ground plane 11 has a project portion 11*a* projecting from the top edge of the interior 15 by the distance Q1 and projects from the side edges of the interior 15 by the certain distance. Further, the second ground plane 11 has a cutout portion 20 (FIG. 2B) at the bottom edge of the opening 19.

The third ground plane 13 is made of electrically conductive material and has no opening. As described above, the third ground plane 13 is disposed on the second surface of the second dielectric substrate 7. The third ground plane 13 covers most of the second surface of the second dielectric substrate 7 as shown in FIG. 2A and fully covers the openings 17, 19 in the longitudinal direction 10 as shown in FIG. 2D.

The first and second ground planes 9, 11 are electrically connected to each other by through holes 23 (FIGS. 1, 2C, 2D) provided in the first dielectric substrate 3. The second and third ground planes 11, 13 are electrically connected to each other by through holes 25 (FIGS. 1, 2A, 2B, 2D) provided in the second dielectric substrate 7. Thus, the first, second, and third ground planes 9, 11, 13 are electrically connected to one another.

As shown in FIG. 2C, the through holes 23 are arranged along the top edge and side edges of the opening 17 to form an approximately C-shape. Likewise, as shown in FIG. 2B, the through holes 25 are arranged along the top edge and side edges of the opening 19 to form the approximately C-shape.

A first wavelength $\lambda r$ of a signal propagating in the first and second dielectric substrates 3, 7 is given by:

$$\lambda r = \frac{\lambda o}{\sqrt{\varepsilon\gamma}} \tag{1}$$

In the equation (1), $\lambda o$ represents a second wavelength of the signal propagating in free space and $\in\gamma$ represents a relative permittivity (i.e., a dielectric constant) of the first and second dielectric substrates 3, 7. A distance between the adjacent through holes 23 is less than or equal to a half of the first wavelength $\lambda r$. Likewise, a distance between the adjacent through holes 25 is less than or equal to a half of the first wavelength $\lambda r$. Thus, the signal can be efficiently propagating in the transition 1 without leaking between the first, second, and third ground planes 9, 11, 13.

The signal propagates through the interior 15 of the waveguide tube 5, a first dielectric portion surrounded by the through holes 23 of the first dielectric substrate 3, and a second dielectric portion surrounded by the through holes 25 of the second dielectric substrate 7. The first and second dielectric portions form a dielectric waveguide.

A cross-sectional area of the dielectric wave member (i.e., substantially the area of each of the openings 17, 19) is determined based on a third wavelength $\lambda p$ of the signal propagating in the dielectric waveguide. Specifically, the cross-sectional area of the dielectric waveguide is reduced, as the third wavelength $\lambda p$ is small. The third wavelength $\lambda p$ is given by:

$$\lambda p = \frac{\lambda o}{\sqrt{\varepsilon\gamma - (\lambda o/2Ae)^2}} \tag{2}$$

As shown in FIG. 1, Ae in the equation (2) represents the length of the cross sectional area of the interior 15 of the waveguide tube 5.

The third ground plane 13 acts as a short-circuited end of the dielectric waveguide. A distance S (FIG. 2D) between the short-circuit end and an antenna 29 (FIGS. 1, 2B and 2D) in the longitudinal direction 10 is about a quarter of the third wavelength λp. The antenna 29 excites and is excited by the waveguide tube 5.

A feeder 21 (FIGS. 1, 2B, 2D) is disposed on the second surface of the first dielectric substrate 3. The feeder 21 includes a planar line 27 (FIGS. 1, 2B) and the antenna 29 connected to the tip of the planar line 27. For example, the planar line 27 is a microstrip line. The planar line 27 is arranged in the cutout portion 20 and the antenna 29 is arranged in the opening 19 so that the feeder 21 has no physical contact with the second ground plane 11. Specifically, the tip of the antenna 29 and the bottom edge of the opening 19 are spaced from each other by a distance L (FIG. 2B) in a direction perpendicular to the longitudinal direction 10. The distance L determines coupling (reflection) characteristics of the transition 1.

Figure 9A:
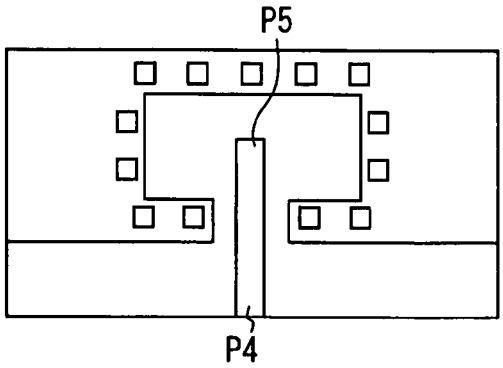
FIG. 9A PRIOR ART
FIG. 9A is a top view of a second ground plane on a dielectric substrate of a conventional transmission line transition.
Figure 9B:
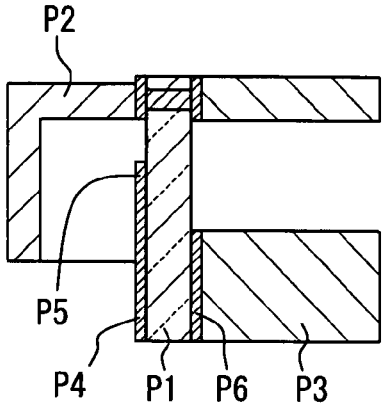
FIG. 9B PRIOR ART
FIG. 9B is a cross-sectional view of the conventional transition, taken along its longitudinal direction.

As described above, in the transition 1 according to the first embodiment, the first dielectric substrate 3 and the second dielectric substrate 7 are laminated to each other to provide the dielectric waveguide. The short-circuit end of the dielectric waveguide is achieved by the third ground plane 13 disposed on the second dielectric substrate 7. Thus, as with the conventional transition shown in FIGS. 9A and 9B, the transition 1 has wideband (broadband) characteristics. The transition 1 achieves the short-circuited end of the dielectric waveguide without using the second waveguide member P2 of the conventional transition. In other words, while the transition 1 uses a single piece waveguide tube, the conventional transition uses a two-piece waveguide tube. Therefore, the transition 1 can be accurately and easily assembled, at least compared to the conventional transition, so that the transition 1 can be mass-produced.

The short-circuited end (i.e., the third ground plane 13) reflects the signal propagating through the waveguide tube 5 and the dielectric waveguide. As a result, a standing wave occurs in the dielectric waveguide. The antenna 29 is positioned at an anti-node of the standing wave. In such an approach, the electromagnetic energy can be efficiently coupled between a first transmission line consisting of the waveguide tube 5 and the dielectric waveguide and a second transmission line consisting of the planar line 27.

The dielectric waveguide is positioned within the cross-sectional area of the interior 15 in the longitudinal direction 10 to prevent occurrence of high-order mode electromagnetic wave. Thus, propagation loss between the dielectric waveguide and the waveguide tube 5 can be reduced.

As shown in FIG. 2D, the first ground plane 9 has the project portion 9*a* projecting from the top edge of the interior 15 by the distance Q1. A distance G (FIGS. 2B, 2D) between the project portion 9*a* and the antenna 29 is kept constant even when the waveguide tube 5 is improperly fixed to the project portion 9*a* of the first ground plane 9. Thus, the project portion 9*a* serves as a margin for error in fixing the waveguide tube 5 to the first ground plane 9 and allows the transition 1 having a desired coupling (reflection) characteristic to be mass-produced.

As described above, the first and second dielectric substrates 3, 7 are made of ceramic such as alumina. In this case, conductive patterns as the ground planes 9, 11, 13 are printed on ceramic green sheets, and then the sheets are laminated to each other and then burned. Alternatively, the first and second dielectric substrates 3, 7 may be made of resin. In this case, conductive sheets as the ground planes 9, 11, 13 are adhered on the resin sheets.

Second Embodiment

Figure 3A:
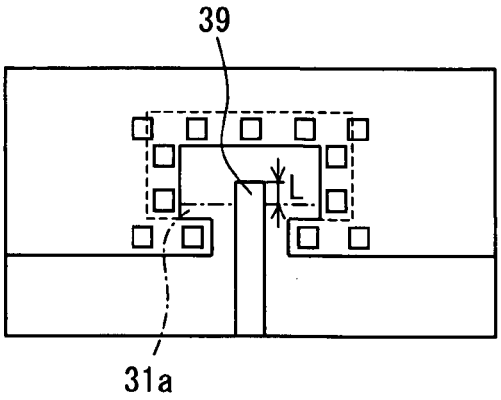
FIG. 3A is a top view of a second ground plane on a first dielectric substrate of a transmission line transition according to a second embodiment of the present invention.
Figure 3B:
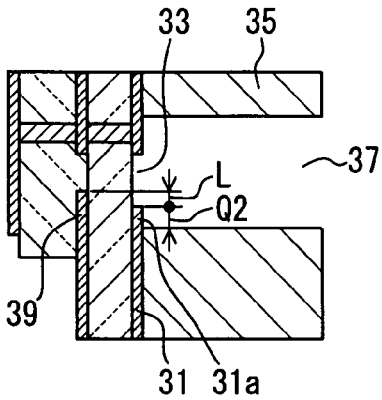
FIG. 3B is a cross-sectional view of the transition according to the second embodiment, taken along its longitudinal direction.

The second embodiment of the present invention is shown in FIGS. 3A and 3B. In the second embodiment, a first ground plane 31 (FIG. 3B) has a project portion 31*a* projecting from a bottom edge of an interior 37 of a waveguide tube 35 by a distance Q2 as shown in FIG. 3B. The tip of an antenna 39 and a bottom edge of an opening 33 FIG. 3B of the first ground plane 31 are spaced from each other by the distance L.

The distance L is kept constant even when the waveguide tube 35 is improperly fixed to the project portion 31*a* of the first ground plane 31. Thus, the project portion 31*a* serves as the margin for error in fixing the waveguide tube 35 to the first ground plane 31 and allows the transition 1 having the desired coupling characteristic to be mass-produced.

Third Embodiment

Figure 4A:
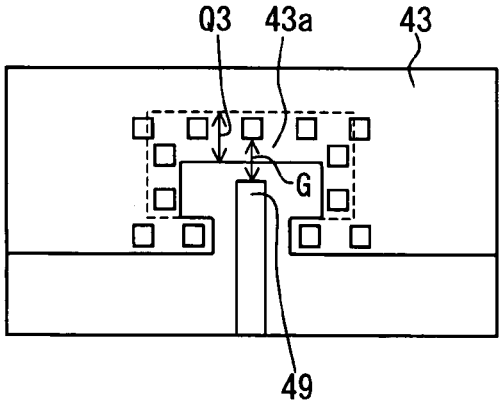
FIG. 4A is a top view of a second ground plane on a first dielectric substrate of a transmission line transition according to a third embodiment of the present invention.
Figure 4B:
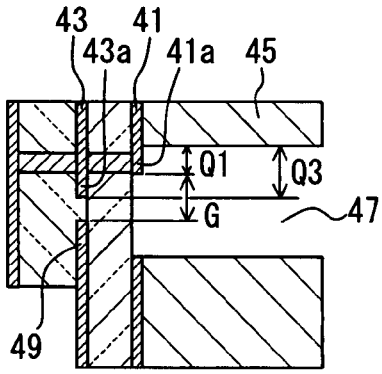
FIG. 4B is a cross-sectional view of the transition according to the third embodiment, taken along its longitudinal direction.

The third embodiment of the present invention is shown in FIGS. 4A and 4B. In the third embodiment, a first ground plane 41 has a project portion 41*a* projecting from a top edge of an interior 47 of a waveguide tube 45 by a distance Q1 as shown in FIG. 4B. A second ground plane 43 has a project portion 43*a* projecting from a top edge of the interior 47 by a distance Q3 greater than the distance Q1. As a result, a distance between the second ground plane 43 and an antenna 49 of the third embodiment is smaller than that between the second ground plane 11 and the antenna 29 of the first embodiment.

In such an approach, double resonance occurs in the dielectric waveguide so that frequency characteristics of propagation of the electromagnetic energy become broadband characteristics. Further, a distance G between the antenna 49 and the first ground plane 41 is kept constant even when the waveguide tube 45 is improperly fixed to the project portion 41*a* of the first ground plane 41. Thus, the project portion 41*a* serves as the margin for error in fixing the waveguide tube 45 to the first ground plane 41 and allows the transition 1 having the desired coupling characteristic to be mass-produced.

The first ground plane may include both the project portion 31*a* shown in FIG. 3B and the project portion 41*a* shown in FIG. 4B. In such an approach, the margin for error in fixing the waveguide tube to the first ground plane can be increased.

Fourth Embodiment

The Fourth embodiment of the present invention is shown in FIGS. 5A-5D. In the embodiments described previously, the planar line and the antenna for exciting the waveguide tube are disposed on the same ground plane. In contrast, in the fourth embodiment, a planar line 51 (FIGS. 5A, 5D) and an antenna 53 (FIGS. 5B, 5D) are disposed on different dielectric substrates. Thus, the planar line 51 and the antenna 53 are disposed at different positions in the longitudinal direction of the dielectric waveguide.

Figure 5A:
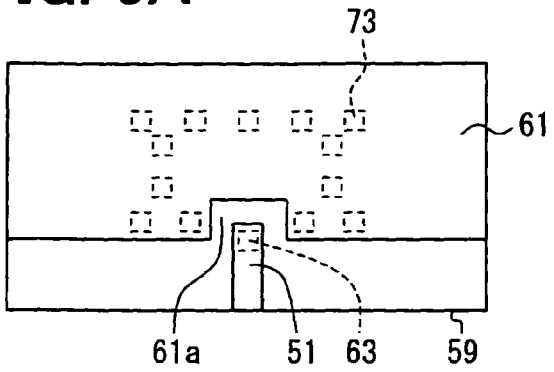
FIG. 5A is a top view of a third ground plane on a second dielectric substrate of a transmission line transition according to a fourth embodiment of the present invention.
Figure 5D:
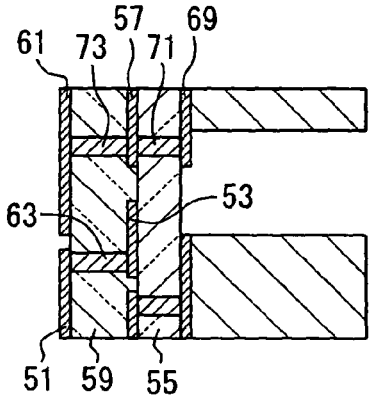
FIG. 5D is a cross-sectional view of the transition according to the fourth embodiment, taken along its longitudinal direction.

Specifically, a first ground plane 69 (FIGS. 5C, 5D) is disposed on a first surface of a first dielectric substrate 55 (FIG. 5D). The antenna 53 and a second ground plane 57 (FIG. 5D) are disposed on a second surface of the first dielectric substrate 55. The planar line 51 and a third ground plane 61 (FIGS. 5A, 5D) are disposed on a second surface of the second dielectric substrate 59 (FIGS. 5A, 5D). The planar line 51 and the antenna 53 are electrically connected to each other by a through hole 63 (FIGS. 5A, 5B, 5D) provided in the second dielectric substrate 59.

Figure 5B:
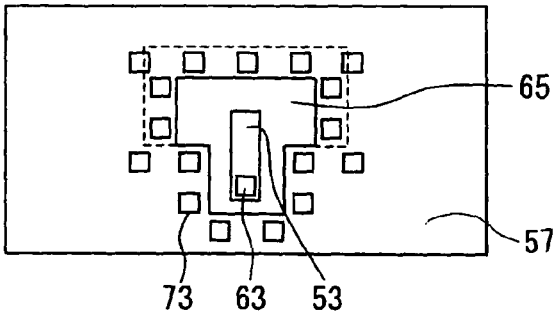
FIG. 5B is a top view of a second ground plane on a first dielectric substrate of the transition according to the fourth embodiment.
Figure 5C:
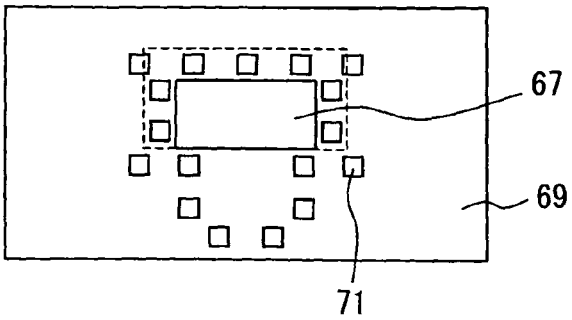
FIG. 5C is a top view of a third ground plane of the transition according to the fourth embodiment.

As shown in FIG. 5A, the third ground plane 61 has a cutout portion 61*a*. The tip portion of the planar line 51 is placed in the cutout portion 61*a* such that the planar line 51 has no physical contact with the third ground plane 61. As shown in FIG. 5B, the second ground plane 57 has an approximately T-shaped opening 65. The antenna 53 is placed in the T-shaped opening 65 such that the antenna 53 has no physical contact with the second ground plane 57. As shown in FIG. 5C, the first ground plane 69 has a rectangular opening 67 equal to the opening 17 of the first embodiment.

The first and second ground planes 69, 57 are electrically connected to each other by through holes 71 (FIGS. 5C, 5D) provided in the first dielectric substrate 55. The second and third ground planes 57, 61 are electrically connected to each other by through holes 73 (FIGS. 5A, 5B, 5D) provided in the second dielectric substrate 59. Thus, the first, second, and third ground planes 69, 57, 61 are electrically connected to one another.

As shown in FIG. 5B, the through holes 73 are arranged along edges of the T-shaped opening 65 to surround the T-shaped opening 65. As shown in FIG. 5C, the through holes 71 are arranged corresponding to the respective through holes 73.

According to the fourth embodiment, the planar line 51 and the antenna 53 are disposed on different ground planes. In such an approach, flexibility in designing the transition 1 can be improved.

Fifth Embodiment

The fifth embodiment of the present invention is shown in FIGS. 6A-6E. In the embodiments described previously, the dielectric waveguide is provided by two dielectric substrates laminated with each other. In contrast, in the fifth embodiment, the dielectric waveguide is provided by three dielectric substrates laminated with each other.

Figure 6A:
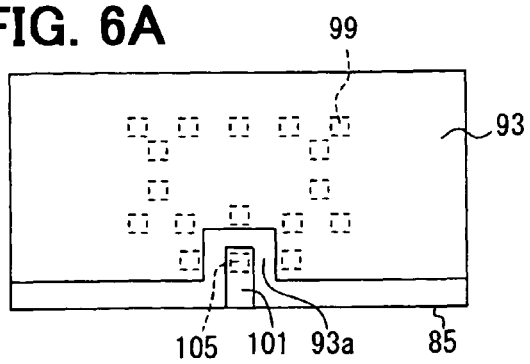
FIG. 6A is a top view of a fourth ground plane on a third dielectric substrate of a transmission line transition according to a fourth embodiment of the present invention.
Figure 6B:
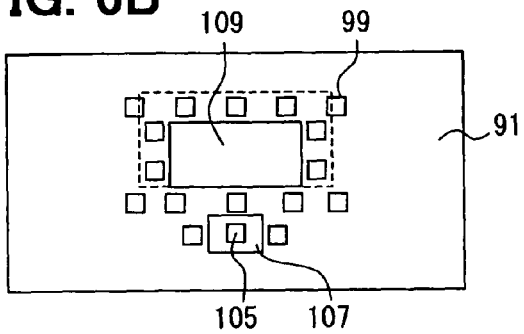
FIG. 6B is a top view of a third ground plane on a second dielectric substrate of the transition according to the fourth embodiment.
Figure 6C:
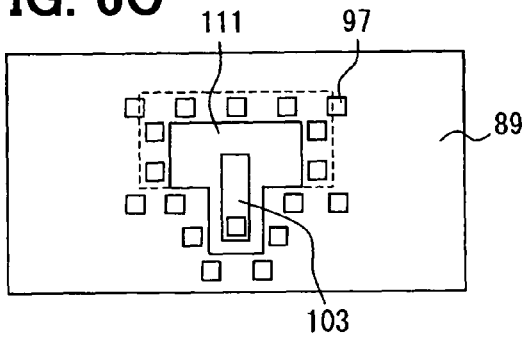
FIG. 6C is a top view of a second ground plane on a first dielectric substrate of the transition according to the fourth embodiment.
Figure 6D:
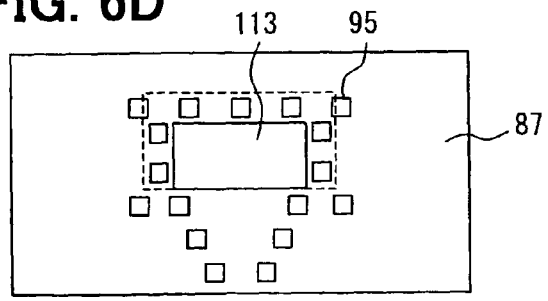
FIG. 6D is a top view of a first ground plane of the transition according to the fourth embodiment.
Figure 6E:
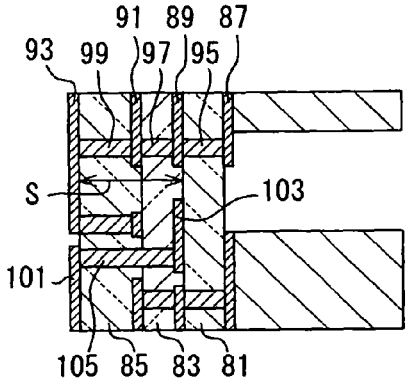
FIG. 6E is a cross-sectional view of the transition according to the fourth embodiment, taken along its longitudinal direction.

Specifically, a transition 1 according to the fifth embodiment includes first, second, and third dielectric substrates 81 (FIG. 6E), 83 (FIG. 6E), 85 (FIG. 6A, 6E) and first, second, third, and fourth ground planes 87 (FIGS. 6D, 6E), 89 (FIGS. 6C, 6E), 91 (FIGS. 6B, 6E), 93 (FIGS. 6A, 6E).

As shown in FIG. 6E, the first ground plane 87 is disposed on a first surface of the first dielectric substrate 81 and sandwiched between the first dielectric substrate 81 and the waveguide tube. The second ground plane 89 is sandwiched between the first and second dielectric substrates 81, 83. The third ground plane 91 is sandwiched between the second and third dielectric substrates 83, 85. The fourth ground plane 93 is disposed on a second surface of the third dielectric substrate 85 and acts as the short-circuited end of the dielectric waveguide.

The first and second ground planes 87, 89 are electrically connected to each other by through holes 95 (FIGS. 6D, 6E) provided in the first dielectric substrate 81. The second and third ground planes 89, 91 are electrically connected to each other by through holes 97 (FIGS. 6C, 6E) provided in the second dielectric substrate 83. The third and fourth ground planes 91, 93 are electrically connected to each other by through holes 99 (FIGS. 6A, 6B, 6E) provided in the third dielectric substrate 85. Thus, the first, second, third, and fourth ground planes 87, 89, 91, 93 are electrically connected to one another.

As with the fourth embodiment, a planar line 101 (FIGS. 6A, 6E) and an antenna 103 (FIG. 6E) are formed on different dielectric substrates. Specifically, the antenna 103 is disposed on a second surface of the first dielectric substrate 81 and the planar line 101 is disposed on the second surface of the third dielectric substrate 85. The planar line 101 and the antenna 103 are electrically connected to each other by a through hole 105 (FIGS. 6A, 6B, 6E) provided in the second and third dielectric substrates 83, 85.

As shown in FIG. 6A, the fourth ground plane 93 has a cutout portion 93*a*. The tip portion of the planar line 101 is placed in the cutout portion 93*a* such that the planar line 101 has no physical contact with the fourth ground plane 93. As shown in FIG. 6B, the third ground plane 91 has a first rectangular opening 109 equal to the opening 17 of the first embodiment and a second rectangular opening 107. The through hole 105, which electrically connects the planar line 101 and the antenna 103, is placed in the second rectangular opening 107 such that the through hole 105 has no physical contact with the third ground plane 91. As shown in FIG. 6C, the second ground plane 89 has an approximately T-shaped opening 111. The antenna 103 is placed in the T-shaped opening 111 such that the antenna 103 has no physical contact with the second ground plane 89. As shown in FIG. 6D, the first ground plane 87 has a rectangle opening 113 equal to the opening 109 of the third ground plane 91.

In the fifth embodiment, a distance S between the antenna 103 and the short-circuited end of the dielectric waveguide can be easily increased so that the flexibility in designing the transition 1 can be improved. As can be seen by comparing (the arrow S of) FIG. 2D and FIG. 6E, the second and third dielectric substrates 83, 85 (FIG. 6E) constitute a dielectric substrate corresponding to the second dielectric substrate 7 (FIG. 2D) of the first embodiment.

Sixth Embodiment

Figure 7:
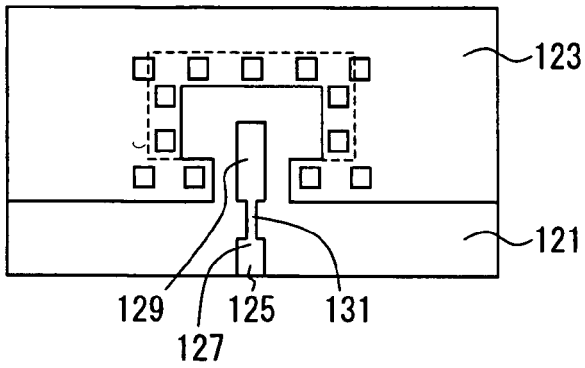
FIG. 7 is a top view of a second ground plane on a first dielectric substrate of a transmission line transition according to a sixth embodiment of the present invention.

The sixth embodiment of the present invention is shown in FIG. 7. A second ground plane 123 and a feeder 125 are disposed on a second surface of a first dielectric substrate 121. The feeder 125 includes a planar line 127, an antenna 129, and an impedance transformer 131. The impedance transformer 131 has a width smaller than that of each of the planar line 127 and the antenna 129 and is connected between the planar line 127 and antenna 129. Thus, the impedance transformer 131 performs impedance matching between the planar line 127 and antenna 129 so that the electromagnetic energy can be coupled highly efficiently.

Seventh Embodiment

Figure 8:
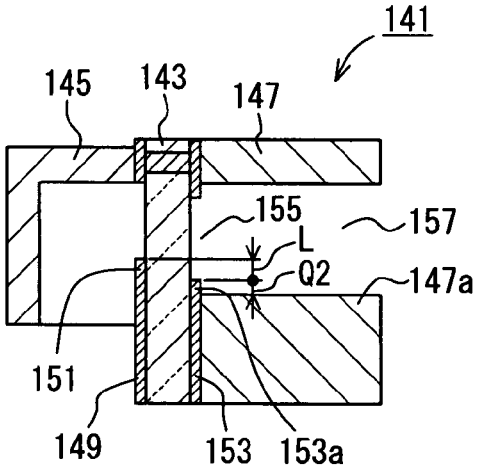
FIG. 8 is a cross-sectional view of a transmission line transition according to a seventh embodiment of the present invention, taken along its longitudinal direction.

A transmission line transition 141 according to the seventh embodiment is shown in FIG. 8. The transition 141 includes a dielectric substrate 143 and a waveguide tube constructed by first and second waveguide members 145, 147 that are fixed to each other through the dielectric substrate 143. Aground plane 153 and a planar line 149 are disposed on first and second surfaces of the dielectric substrate 143, respectively. The tip portion of the planar line 149 is positioned inside a hollow interior 157 of the waveguide tube and acts as an antenna 151 for exciting the waveguide tube.

The area of an opening 155 of the ground plane 153 is smaller than a cross-sectional area of the hollow interior 157 and the opening 155 is positioned within the interior 157 in a longitudinal direction of the waveguide tube. Specifically, the ground plane 153 has a project portion 153*a* projecting from a bottom edge of the interior 157 by a distance Q2. Therefore, a distance L between the tip of the antenna 151 and the ground plane 153 of the seventh embodiment is smaller than that between the tip of the antenna 29 and the first ground plane 9 of the first embodiment.

The distance L is kept constant even when the second waveguide member 145 is improperly fixed to the project portion 153*a*. Thus, the project portion 153*a* serve as the margin for error in fixing the second waveguide member 145 to the ground plane 153 and allows the transition 141 having the desired coupling characteristic to be mass-produced.

(Modifications)

The embodiment described above may be modified in various ways. For example, the dielectric waveguide may be provided by four or more dielectric substrates laminated to each other. The first dielectric can include a plurality of dielectric substrate members laminated to each other. The planar line may be a slot line, a coplanar line, a tri-plate type line, or the like that can be formed on the dielectric substrate. The through holes may be via holes.

Such changes and modifications are to be understood as being within the scope of the present invention as defined by the appended claims.

What is claimed is:

1. A transmission line transition for coupling electromagnetic energy comprising:

a first dielectric substrate having a first portion;

a waveguide tube including a hollow interior that has a longitudinal direction and a first cross-sectional area perpendicular to the longitudinal direction, one open end of the waveguide tube being attached to a first surface of the first dielectric substrate;

a second dielectric substrate disposed on a second surface of the first dielectric substrate and having a second portion, the second portion and the first portion of the first dielectric substrate providing a dielectric waveguide having a first end short-circuited and a second end communicating with the hollow interior of the waveguide tube;

a planar line located between the first and second dielectric substrates;

an antenna located between the first and second dielectric substrates, the antenna being electrically connected to the planar line, the antenna being disposed in the dielectric waveguide to excite and to be excited by the waveguide tube, the antenna being spaced from the short-circuited end of the dielectric waveguide by a predetermined distance in the longitudinal direction;

a first ground plane located between the first dielectric substrate and the waveguide tube;

a second ground plane located between the first and second dielectric substrates; and a third ground plane located on the second dielectric substrate to provide the first short-circuited end of the dielectric waveguide, wherein the electromagnetic energy is coupled between the waveguide tube, the dielectric waveguide, and the planar line;

each of the first and second dielectric substrates has a plurality of conductive members for electrically connecting the first, second and third ground planes;

the dielectric waveguide is surrounded by the plurality of conductive members;

the second ground plane has a first project portion projecting inwardly over the hollow interior of the waveguide tube by a first distance, the first project portion projecting from an edge of the plurality of the conductive members toward the antenna;

the first ground plane has a second project portion projecting inwardly over the hollow interior of the waveguide tube by a second distance less than the first distance; and a terminal end of the antenna is spaced by a third distance relative to an edge of the first projection portion in a longitudinal direction of the antenna and is spaced by a fourth distance greater than the third distance relative to an edge of the second projection portion in the longitudinal direction of the antenna.

2. The transition according to claim 1, wherein the dielectric waveguide coincides with the hollow interior of the waveguide tube in the longitudinal direction and has a second cross-sectional area smaller than the first cross-sectional area of the hollow interior, and the second cross-sectional area is inside the first cross-sectional area in the longitudinal direction.

3. The transition according to claim 1, wherein the planar line and the antenna are disposed at different positions in the longitudinal direction.

4. The transition according to claim 1, further comprising:

an impedance transformer connected between the planar line and the antenna to perform impedance matching between the planar line and the antenna.

5. The transition according to claim 1, wherein the distance between the antenna and the short-circuited end is about a quarter of a wavelength of a signal propagating in the dielectric waveguide.

6. The transition according to claim 1, wherein the planar line is a microstrip line.

7. The transition according to claim 1, wherein the first dielectric substrate includes a plurality of dielectric substrate members laminated to each other.

8. The transition according to claim 1, wherein the second dielectric substrate includes a plurality of dielectric substrate members laminated to each other.

9. A transmission line transition for coupling electromagnetic energy comprising:

a first dielectric substrate having a first portion;

a waveguide tube including a hollow interior that has a longitudinal direction and a first cross-sectional area perpendicular to the longitudinal direction, one open end of the waveguide tube being attached to a first surface of the first dielectric substrate;

a second dielectric substrate disposed on a second surface of the first dielectric substrate and having a second portion, the second portion and the first portion of the first dielectric substrate providing a dielectric waveguide having a first end short-circuited and a second end communicating with the hollow interior of the waveguide tube;

a planar line located between the first and second dielectric substrates;

an antenna located between the first and second dielectric substrates, the antenna being electrically connected to the planar line, the antenna being disposed in the dielectric waveguide to excite and to be excited by the waveguide tube, the antenna being spaced from the short-circuited end of the dielectric waveguide by a predetermined distance in the longitudinal direction;

a first ground plane located between the first dielectric substrate and the waveguide tube;

a second ground plane located between the first and second dielectric substrates; and a third ground plane located on the second dielectric substrate to provide the short-circuited first end of the dielectric waveguide, wherein the electromagnetic energy is coupled between the waveguide tube, the dielectric waveguide, and the planar line; and the second dielectric substrate includes a plurality of dielectric substrate members laminated to each other, each of the first and second dielectric substrates has a plurality of conductive members for electrically connecting the first, second and third ground planes, the dielectric waveguide is surrounded by the plurality of conductive members, the second ground plane has a first project portion projecting inwardly over the hollow interior of the waveguide tube by a first distance, the first project portion projecting from an edge of the plurality of the conductive members toward the antenna;

the first ground plane has a second projection portion projecting inwardly over the hollow interior of the waveguide tube by a second distance less than the first distance; and a terminal end of the antenna is spaced by a third distance relative to an edge of the first projection portion in a longitudinal direction of the antenna and is spaced by a fourth distance greater than the third distance relative to an edge of the second projection portion in the longitudinal direction of the antenna.

10. The transition according to claim 9, wherein the dielectric waveguide coincides with the hollow interior of the waveguide tube in the longitudinal direction and has a second cross-sectional area smaller than the first cross-sectional area of the hollow interior, and the second cross-sectional area is inside the first cross-sectional area in the longitudinal direction.

11. The transition according to claim 9, further comprising:

an impedance transformer connected between the planar line and the antenna to perform impedance matching between the planar line and the antenna.

12. The transition according to claim 9, wherein the distance between the antenna and the short-circuited end is about a quarter of a wavelength of a signal propagating in the dielectric waveguide.

13. The transition according to claim 9, wherein the planar line is a microstrip line.

* * * * *